US005165667A

United States Patent [19]

Dabney

[11] Patent Number: 5,165,667

[45] Date of Patent: Nov. 24, 1992

[54] BOX SPRING ASSEMBLY WITH CROSSWIRES HAVING INTEGRAL SINUOUS END SPRINGS

[75] Inventor: Upton R. Dabney, Lexington, Ky.

[73] Assignee: Hoover Group, Inc., Alpharetta, Ga.

[21] Appl. No.: 850,386

[22] Filed: Mar. 11, 1992

Related U.S. Application Data

[63] Continuation-in-part of Ser. No. 574,107, Aug. 29, 1990, abandoned.

[51] Int. Cl.[5] ..... F16F 3/02; A47C 23/16

[52] U.S. Cl. ..... 267/103; 267/110; 5/255

[58] Field of Search ..... 5/247, 255, 260, 476; 267/103, 107, 109, 110

[56] References Cited

U.S. PATENT DOCUMENTS

| | | | |
|---|---|---|---|
| 3,574,241 | 4/1971 | Slominski | 5/247 R |
| 3,722,013 | 3/1973 | Surletta | 5/247 |
| 4,238,861 | 12/1980 | Mizelle | 5/247 |
| 4,339,834 | 7/1982 | Mizelle | 267/107 X |
| 4,398,705 | 8/1983 | Mizelle | 5/247 X |
| 4,470,584 | 9/1984 | Mizelle | 5/247 X |
| 4,730,357 | 3/1988 | Wells | 267/107 X |
| 4,776,572 | 10/1988 | Surletta et al. | 267/107 |
| 4,779,293 | 10/1988 | Dabney et al. | 5/247 |
| 4,867,424 | 9/1989 | Dabney | 5/246 X |
| 4,891,853 | 1/1990 | Dabney | 267/107 X |
| 4,907,785 | 3/1990 | Dabney | 5/247 X |
| 4,921,228 | 5/1990 | Lowe | 267/103 |
| 4,932,535 | 6/1990 | Dabney | 267/107 X |
| 5,054,751 | 10/1991 | Brown | 267/103 |

FOREIGN PATENT DOCUMENTS

| | | | |
|---|---|---|---|
| 85229 | 8/1983 | European Pat. Off. | 5/247 |
| 128680 | 12/1984 | European Pat. Off. | 5/247 |
| 2072500 | 10/1981 | United Kingdom | 5/247 |

*Primary Examiner*—Robert J. Oberleitner
*Assistant Examiner*—Alfred Muratori
*Attorney, Agent, or Firm*—Harness, Dickey & Pierce

[57] ABSTRACT

A box spring assembly in which the mattress support deck is supported by crosswires having integral, planar, sinuous end springs to provide improved peripheral support. Intermediate support springs are interwoven on the crosswires thus eliminating the need of retaining clips in assembly. The interweaving of the support springs on the crosswires allows the support springs, crosswires and integral sinuous end springs to act as a single entity. So constructed, the cost of manufacture is lowered and the ease of manufacture is increased.

15 Claims, 5 Drawing Sheets

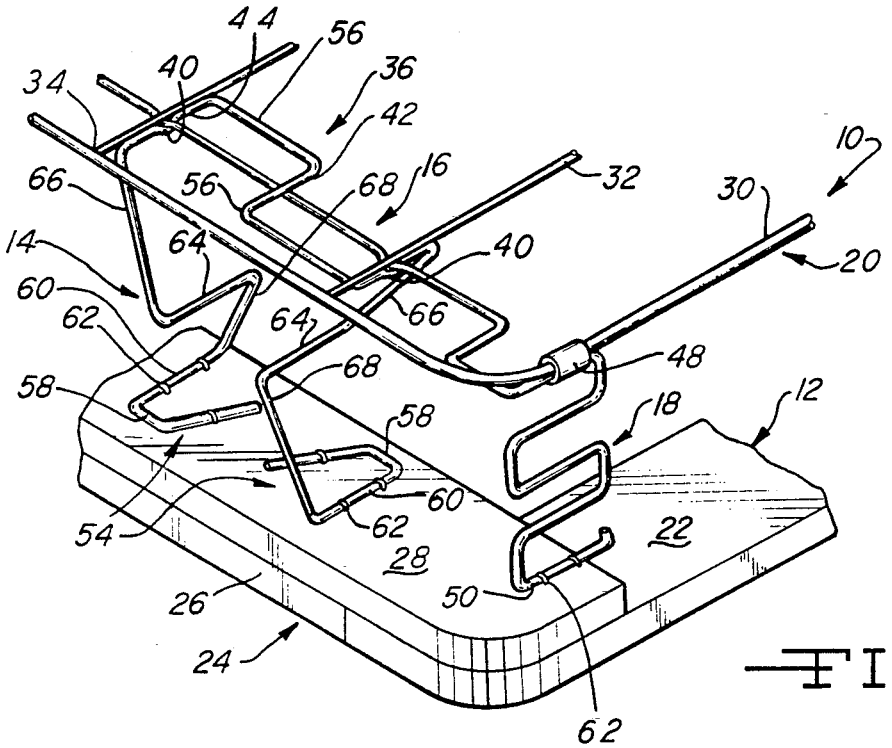
FIG. 1
FIG. 2
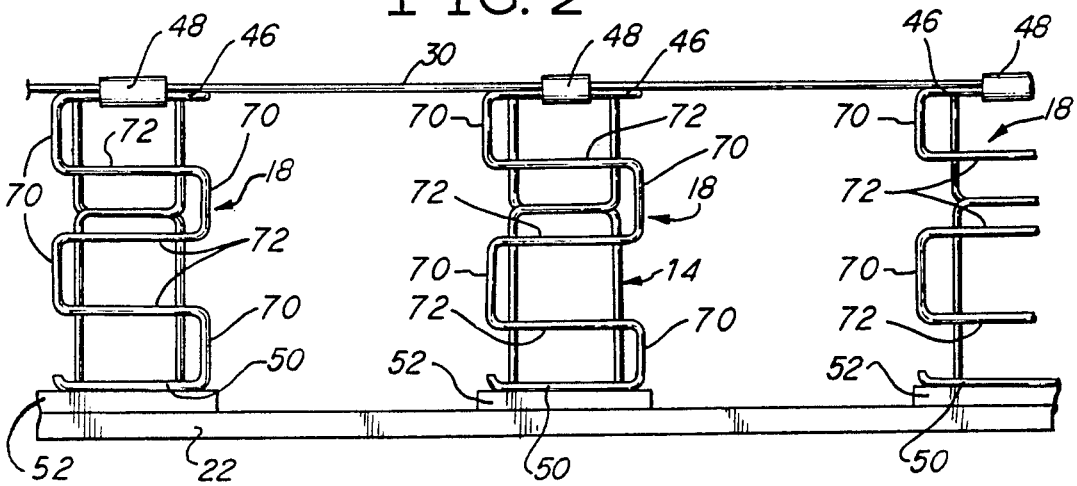

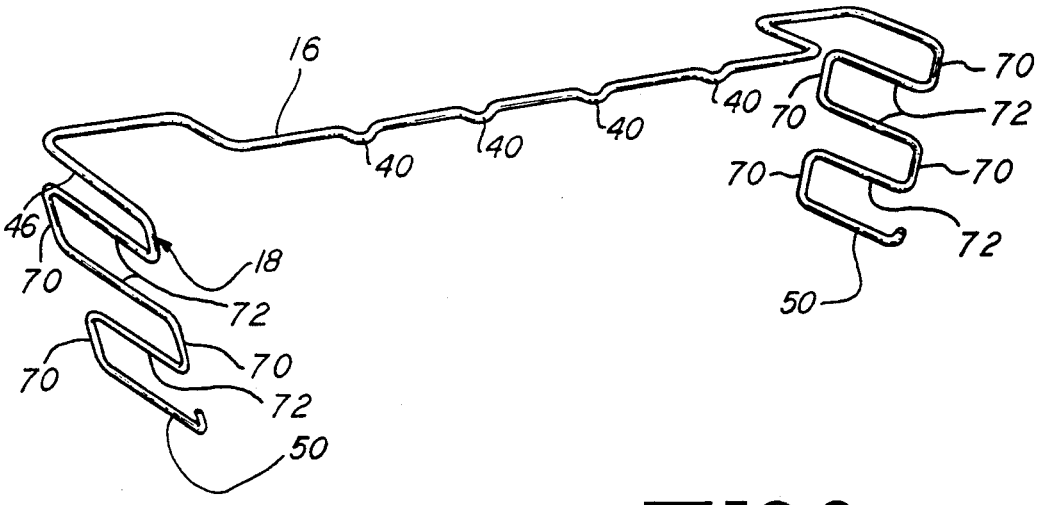
FIG. 3
FIG. 4
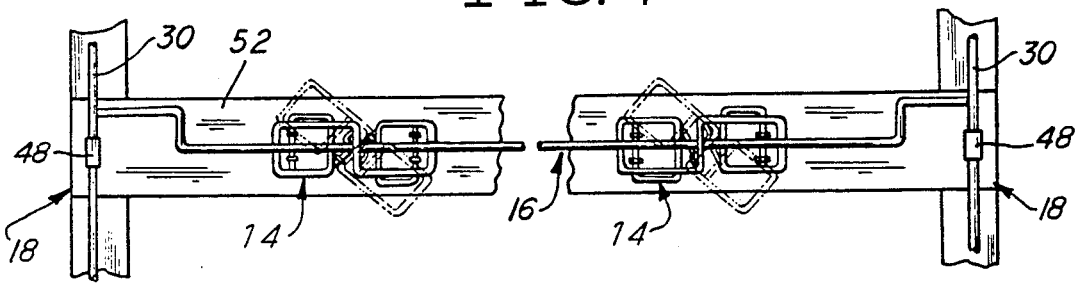
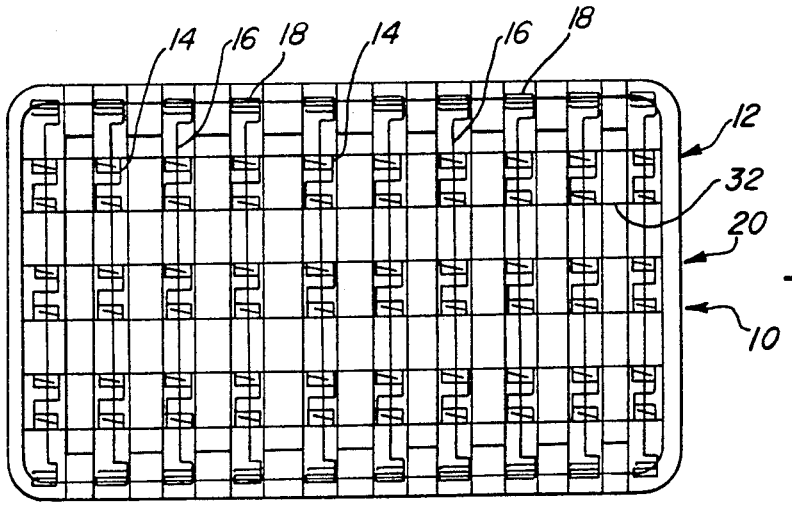
FIG. 5

BOX SPRING ASSEMBLY WITH CROSSWIRES HAVING INTEGRAL SINUOUS END SPRINGS

RELATED APPLICATIONS

This application is a continuation-in-part of U.S. patent application Ser. No. 574,107, filed Aug. 29, 1990 now abandoned.

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; 4,371,152; 4,398,705; 4,470,584; 4,452,438; 4,739,977; 4,779,292; 4,779,293; 4,805,883; 4,861,002; 4,867,424; 4,891,853; 4,907,785; 4,921,228; and 4,932,535.

Box spring assemblies of the general type shown in the above list of patents, all of which are owned by the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

It is a principal object of this invention to provide an improved support foundation in a box spring assembly, particularly peripheral support. This is achieved by constructing the box spring assembly with crosswires that include integral sinuous end springs which, like the rest of the assembly components, are made of spring wire to provide added support and stiffness.

It is a further object of this invention to combine the various box spring components, the cross wire, intermediate springs, and sinuous and springs, into a single entity to lower the cost of manufacturing and make it easier to assemble.

SUMMARY OF THE INVENTION

The box spring assembly of this invention consists of a rectangular frame having side rails, end rails, and a plurality of cross rails that are generally parallel to each other and to the end rails while being substantially perpendicular to the side rails. The box spring assembly also includes a generally horizontal mattress support deck disposed a predetermined distance above the frame and formed entirely of spring wire. Spring wire is a high carbon heat treated steel which has the "springiness" characteristic necessary to enable it to deflect under load conditions and then return to its initial position when the load is released. Furthermore, the support deck includes individual crosswires having integral sinuous end springs. The end springs provide support to the peripheral boundary. This is in contrast to mattress support decks that are supported by intermediate springs and corner springs only. The end springs in this invention are of a sinusoidal shape and formed of spring wire so as to make them stiffer than any that have preceded them. The end springs are also mounted to the frame of the assembly so as to be substantially vertically oriented which enhances the end springs resistance to bending loads resulting in a stiffer spring along the periphery of the assembly. The benefit of this added stiffness is that a person sitting on the peripheral portion of the bed will be completely supported. With this increase in stiffness the foundation will not sag or slant in a fashion that will cause the person to slip off the edge.

The mattress support deck in the present invention is a grid structure formed of a plurality of a substantially straight wire members, arranged in a criss-cross fashion, and a generally rectangular border wire defining the load supporting area of the deck. Some of the straight wire members extend lengthwise of the border wire and others crosswise. A plurality of substantially straight crosswires extend across the frame and are attached to the border wire at both sides. The crosswires are located just below the other members of the support deck and, as mentioned above, are formed with integral sinuous end springs, directed substantially vertically downward, at both ends. A plurality of deck support springs are interwoven on each crosswire and extend downward toward the frame in a manner calculated to increase the ease of manufacturing. The arrangement of crosswires, sinuous end springs and support springs acts as a single entity or unit yieldably supporting the longwires and borderwire above the frame. This arrangement is further secured in an interacting relation so as to stabilize the deck against lateral sway.

In an alternative embodiment, the longwires are also provided with integral sinuous end springs to provide increased stiffness and support along the end periphery of the assembly.

This box spring assembly provides an improved peripheral support foundation for the mattress support deck. Through the combination and fitting of the various box spring components, less work is required to construct the assembly, thus making it easier and cheaper to manufacture.

Further objects, features, and advantages of this invention will become apparent from a consideration of the following description, the appended claims, and the accompanying drawings.

BRIEF DESCRIPTION OF THE DRAWINGS

FIG. 1 is a fragmentary perspective view of the box spring assembly of this invention showing one crosswire with its integral sinuous end spring and one intermediate support spring;

FIG. 2 is a side elevation view of a portion of the box spring assembly showing the sinuous end springs of the crosswires and also showing the intermediate support springs;

FIG. 3 is a perspective view of a crosswire having sinuous end springs;

FIG. 4 is a plan view of a portion of the present invention showing the attachment of the intermediate support springs to the crosswire and the mounting position of the sinuous end springs;

FIG. 5 is a diagrammatic plan view of the box spring assembly illustrating an in-line arrangement of the intermediate support springs along the crosswires and on the frame to support the wire deck;

DETAILED DESCRIPTION OF THE INVENTION

Figure 6:
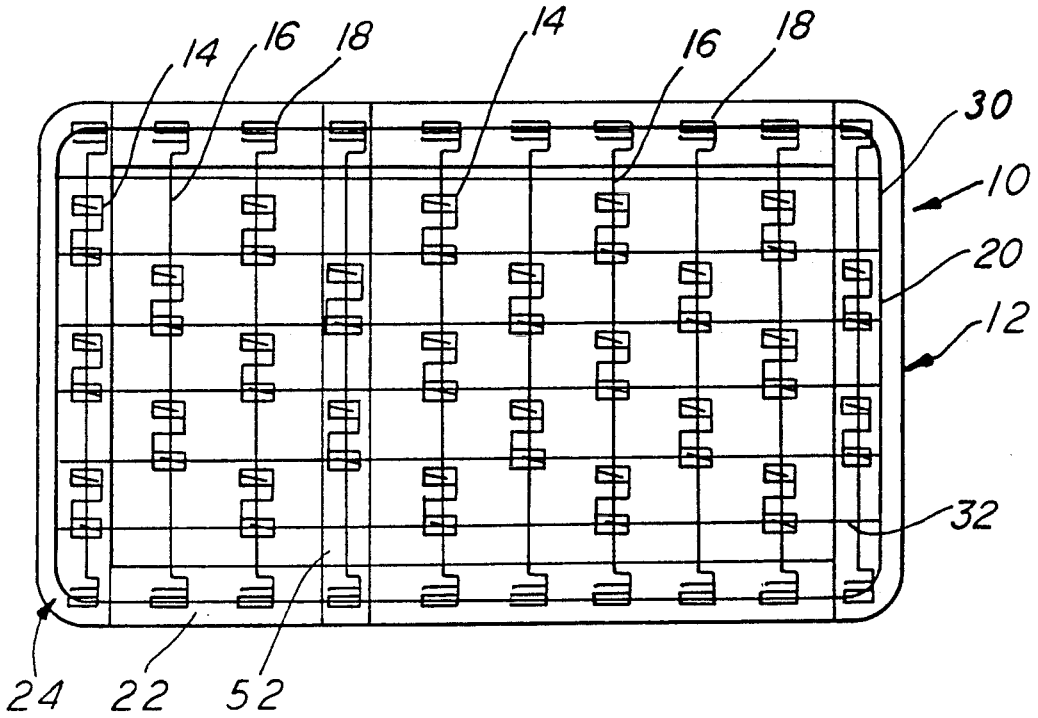
FIG. 6 is a diagrammatic plan view of a box spring assembly illustrating an offset arrangement of the intermediate support springs along the crosswires.

With reference to the drawing, a fragmentary portion of the box spring assembly of this invention, indicated generally at 10, is illustrated in FIG. 1. The box spring assembly 10 includes a generally rectangular, horizontally disposed frame 12, a plurality of deck or intermediate support springs 14, a plurality of individual crosswires 16 having integral sinuous end springs 18, and a horizontally disposed wire mattress support deck 20 being supported a predetermined distance above the frame 12.

The frame 12, generally constructed of wood, has side rails 22 and end rails 24. The end rails 24 include a lower member 26, each end of which is connected to a side rail 22, and an upper member 28. The upper member 28 further secures the frame 12 by overlapping both the lower member 26 and the end of side rail 22. Horizontally spaced parallel to the end rails 24 are a plurality of cross rails 52 which are coplanar with the upper members 28 of end rails 24 and also overlap the side rails 22. The intermediate springs 14 and end springs 18 are mounted to the cross rails 52 in identical fashion to that illustrated in FIG. 1, where the springs 14 and 18 are shown mounted to the upper member 28 the end rail 24.

The wire mattress support deck 20 forms a horizontal platform, and, as mentioned above, is disposed a predetermined distance above the frame 12. The support deck 20 includes a continuous border wire 30, long wires 32, and the crosswires 16 having integral sinuous end springs 18. The long wires 32 are arranged lengthwise in the box spring assembly 10 so that they lie in a plane above the crosswires 16 and are supported by the crosswires 16 and the sinuous end spring 18. The long wires 32 terminate in end sections 34 that are welded, or secured in another conventional manner, to the border wire 30.

Spring systems used in box spring assemblies of this type generally have both a load bearing portion and a yieldable portion. In the present assembly 10, the load bearing portion is represented by the crosswires 16, long wires 32 and a generally horizontal upper attaching portion 36 of the intermediate support springs 14. The sinuous end springs 18 and a lower portion 38 of the intermediate springs 14 act as the yieldable portion.

As best seen in FIG. 3, each crosswire 16 has a plurality of downwardly arched notches 40 spaced along its length. Pairs of adjacent notches 40 are straddled or saddled by an intermediate straight wire section 42 or crossing portion of the intermediate spring 14. Upper transverse torsion bars 44 of the intermediate spring 14 are themselves saddled by the crosswires 16 to interwovenly engage the support deck 20 with the intermediate springs 14.

In mounting the intermediate springs 14, the springs 14 are positioned over the crosswire 16, shown by phantom lines in FIG. 4, and are rotated into their final position. With the intermediate spring 14 in its final position, the crosswire 16 first saddles one of the transverse torsion bars 44, is then itself saddled between two notches 40 by the intermediate straight wire 42 of the intermediate spring 14, and finally, the crosswire 16 saddles the remaining transverse torsion bar 44. Thus the intermediate spring 14 is secured to the crosswire 16 in an interwoven fashion. All of the intermediate springs 14 ar attached to the support deck 20 in this manner without the use of clips or other extraneous wire.

A plurality of limited deflection intermediate support springs 14 are arranged in a predetermined pattern on frame 12. Along with the crosswires 16 and integral sinuous end sections 18, the intermediate springs 14 yieldably support the deck 20 in position above the frame 12. Such positioning allows resilient movement of the deck 20 toward the frame 12 and accommodates bedding loads. The pattern and number of springs 14 will vary depending upon the manufacturing and support considerations of the specific assembly 10. Two preferred patterns of spring placement are illustrated in FIGS. 5 and 6. FIG. 5 is an in-line arrangement, while FIG. 6 is an alternating arrangement. For the sake of clarity, only one cross rail 52 is shown in FIG. 6.

Each sinuous end spring 18 and crosswire 16 is attached to the border wire 30 by clips 48. This attachment of the end springs 18, in conjunction with interwoven mounting of the intermediate springs 14, prevents the support deck 20 from experiencing lateral movement or side sway. The lower portions 50 of the end springs 18 are mounted by staples 62, or other conventional means, to the appropriate members of the frame 12. The staple 62 attachment is also utilized where the lower portions of the intermediate springs 14 are attached to the frame 12.

As best seen in FIGS. 7 through 11, each intermediate support spring 14 has an upright yieldable portion 38. The yieldable portion 38 is integrally formed at its upper end with the upper attaching portion 36 and is integrally formed at its lower end with a horizontal mounting portion 54.

The upper attaching portion 36 generally serves as a support platform for the wire deck 20 and consists of the intermediate straight wire section 42, a pair of upper transverse torsion bars 44, and a pair of crosswise sections 56. The upper torsion bars 44 are disposed on opposite sides of intermediate straight section 42 in a spaced and parallel relationship. The crosswise sections 56 integrally connect the torsion bars 44 to opposite ends of the intermediate section 42.

The lower mounting portion 54 is comprised of a pair of substantially horizontally disposed mounting feet 58. A pair of lower transverse torsion bars 60 connect the mounting feet 58 to the yieldable portions 38. The lower torsional bars 60 are positioned so as to be generally paralleled to the upper transverse torsional bars 44. As mentioned previously, the intermediate springs 14 are secured to the frame 12 by staples 62, which may be mounted over both the lower torsion bars 60 and the mounting feet 58.

Figure 7:
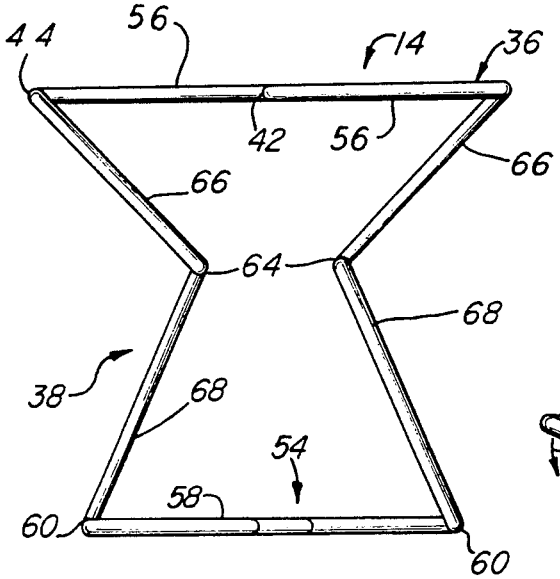
FIG. 7 is an isolated elevational view of one intermediate support spring of this invention in an unloaded position.
Figure 8:
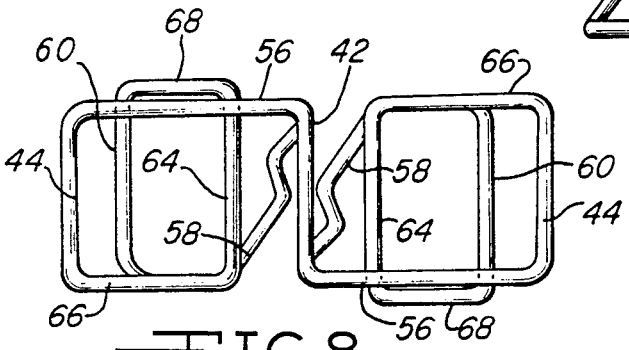
FIG. 8 is a plan view of the support spring shown in FIG. 7.
Figure 11:
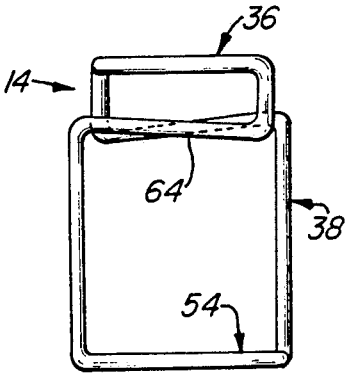
FIG. 11 is an end elevational view taken generally along line 11—11 in FIG. 9 of the loaded spring.
Figure 10:
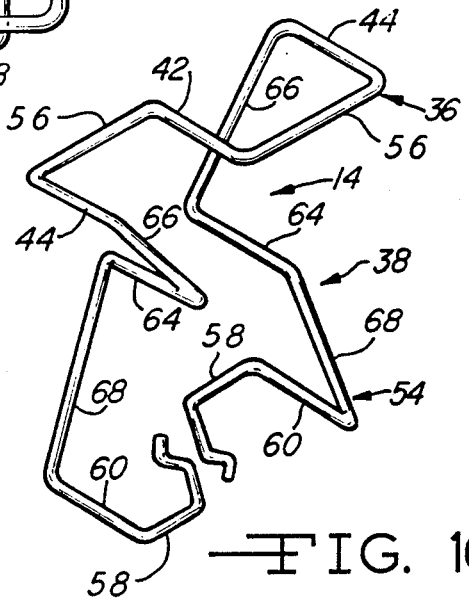
FIG. 10 is a perspective view of the intermediate support spring shown in FIG. 7.

The intermediate yieldable portion 38 is comprised of a pair of vertically deflectable column sections which resiliently support and connect the upper attaching portion 36 to the lower mounting portion 54. Each column section is comprised of a middle transverse torsion bar 64, an upper connecting bar 66 and a lower connecting bar 68. The middle torsion bar 64 is generally parallel to both the upper torsion bar 44 and the lower torsional bar 60. The upper connecting bar 66 connects one end of the middle torsion bar 64 to a corresponding end of an upper torsion bar 44 and the lower connecting bar 68 connects the opposite end of the middle torsion bar 64 with a corresponding end of a lower torsion bar 60. As seen in FIGS. 7 and 8, the middle torsion bar 64 is positioned somewhat inward of both the upper and lower torsion bars 44 and 60.

The upper transverse torsion bars 44 can be provided with a coating of a yieldable plastic material, as disclosed in U.S. Pat. No. 4,186,223, also assigned to the assignee of this application. The plastic coating may be a vinyl coating, a polyurethane coating or some other soft plastic which, when applied, completely covers the areas of the springs 14 which engage the deck 20. In this fashion, unwanted noise, caused by relative movement of the deck 20 and the springs 14, can be eliminated.

When a downward load is applied to the mattress support deck 20, the support springs 14 and sinuous end springs 18 will vertically yield to accommodate the load and provide comfort and support to the occupant of a mattress positioned thereabove.

The sinuous end springs 18 are mounted so as to extend substantially vertically upward from the frame 12. As see in FIGS. 1, 2 and 3, the sinuous end springs 18 are substantially planar and are integrally formed with the crosswires 16. Each sinuous end spring 18 includes an upper member 46 which is secured to the border wire 30 by the clips 48 previously mentioned. Between the upper member 46 and the lower portions 50, the sinuous end springs 18 are composed of a series of alternating vertical and horizontal sections, designated at 70 and 72. While variations may be employed, in the illustrated embodiment, three horizontal sections 72 are interconnected by four vertical sections 70 between the upper member 46 and the lower portion 50 giving the end springs 18 their sinuous shape. Oriented and constructed as such, the sinuous end springs 18 are highly resistant to bending loads and permit only a very limited amount of vertical deflection. Thus, an occupant will have substantial support at the peripheral boundary of the assembly 10.

As used in this application, sinuous is defined as being a shape which generally corresponds with the sinusoidal shape of a sine wave, square wave or similar configuration.

During the application of a load to the peripheral boundary of the support deck 20, the substantially vertical mounting of the sinuous springs 18 enables the springs 18 to effectively resist deflection. When a downwardly applied load is partially directed at the peripheral boundary, the above assembly 10 limits boundary deflection to the deflection experienced by the remainder of the support deck 20. The stiff action of the sinuous end springs 18 gives the occupant a "stability" feeling as opposed to the "sliding off" feeling induced when the boundary has deflected an amount greater than the remainder of the support deck 20.

Figure 9:
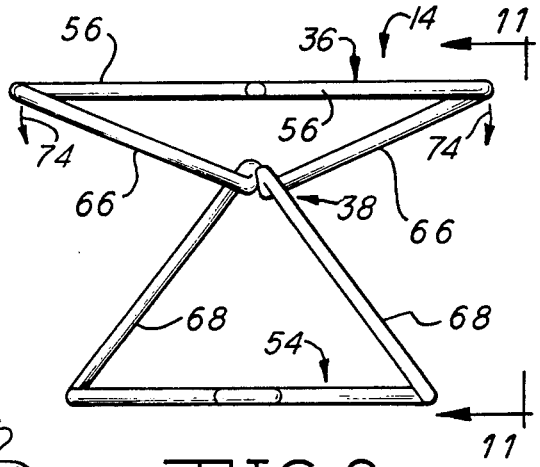
FIG. 9 is an elevational view of one intermediate support spring of this invention in a loaded position showing engagement of the torsion bars of the column sections limiting deflection of the spring.

During deflection of the intermediate support springs 14, the middle torsion bars 64 are displaced downward until invariably abutting one another, as seen in FIG. 9. This engagement limits the downward deflection of the support deck 20 to some predetermined distance above the frame 12.

In the fully deflected position, lower connecting bars 68 form a generally fixed triangular support which further limits the vertical deflection of the spring. The abutting torsion bars 64 form a fulcrum point about which the upper attaching portion 36 may pivot in the direction shown by arrows 74. This pivoting action allows portions of the deck 20 to deviate from a generally horizontal plane and conform to the applied loads. In this manner, increased comfort is provided to the occupant by the box spring assembly 10. Other applications and functions of this particular type of support spring 14 are further described in U.S. patent application Ser. No. 264,024, now U.S. Pat. No. 4,891,853, also assigned to the assignee of the present application.

Figure 12:
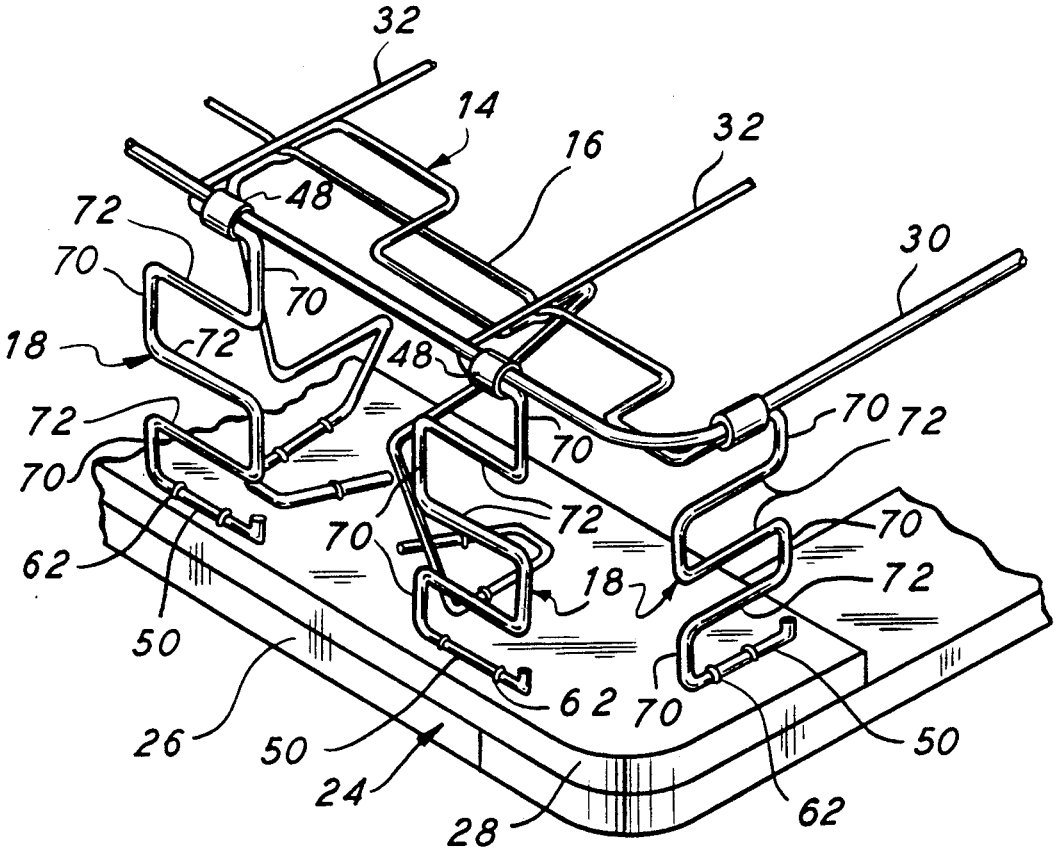
FIG. 12 is a fragmentary perspective view of the box spring assembly of this invention showing a second embodiment having crosswires and longwires with integral sinuous end springs.
Figure 13:
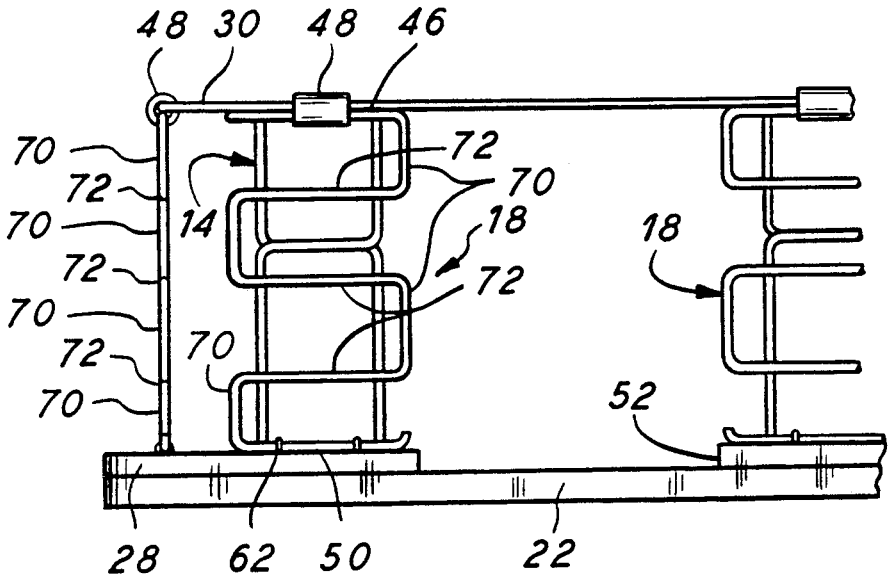
FIG. 13 is a side elevational view of a portion of the box spring assembly in FIG. 12 showing the sinuous end springs and their being substantially vertically mounted to the frame.

A second embodiment of the present invention is illustrated in FIGS. 12 and 13. In addition to the crosswires 16, the long wires 32 of the second embodiment are also provided with integral sinuous end springs 18. Like the previous embodiment, the sinuous end springs 18 are secured to the border wire 30 by clips 48 and to the frame 12 by staples 62. As seen in FIG. 13, the sinuous end springs 18 are substantially vertically oriented in their mounted position with the frame 12. When mounted in this manner, the sinuous end springs 18 resist bending loads being applied to them through the bedding load applied to the assembly.

The box spring assembly of the present invention is desirable for several reasons. First, the crosswires 16, sinuous end springs 18, and support springs 14 limit the deflection of the support deck 20 when a bedding load is applied. Furthermore, the crosswires 16 and sinuous end springs 18 are advantageous in that they are stiffer and provide increased resistance and resilience to these loads. The assembly 10 is thus provided with a longer service life by preventing any portion of the assembly 10 from becoming permanently "set".

Another advantage of the invention is the interwoven nature of the crosswires 16 and the intermediate springs 14. By having the crosswires 16 "weave" over the upper torsion bars 44 and under the intermediate straight wire section 42, the need for clips attaching the intermediate springs 14 to the crosswires 16 is eliminated. Rather, the support deck 20 is completely secured in its position by the attachment of the sinuous end springs 18 to the border wire 30. The elimination of the excess clips and the ease of mounting the intermediate springs 14 to the crosswire 16 make the invention desirable from both a cost and an ease of manufacture standpoint.

The intermediate spring 14 used in the present application can be substituted with other limited deflection springs that perform generally the same function.

It is to be understood that the present invention is not limited to the exact construction or method illustrated and described above, but that various changes may be made without departing from the spirit and scope of the invention as defined in the following claims.

What is claimed is:

1. A box spring assembly comprising:

a generally horizontal rectangular frame having a generally horizontal mattress support deck disposed a predetermined distance thereabove and formed of spring wire, said support deck including a border wire aligned substantially vertically with said frame, and a plurality of substantially straight wire members extending lengthwise of said frame and connected to said border wire;

a plurality of crosswire members extending crosswise of said frame and being disposed a predetermined distance thereabove, said crosswire members having at opposite ends integrally formed end springs, said end springs being fixedly attached to said border wire and extending downward therefrom to said frame, each of said end springs being oriented in a substantially upright plane and being sinuous in shape and providing a desired stiffness to said border wire on opposite sides of said support deck, both said crosswire members and said end springs being formed of spring wire; and a plurality of intermediate deck support springs in interwoven engagement with said crosswire members and being arranged between said deck and said frame so as to yieldably support said deck on said frame, said intermediate springs further being fixedly attached to said frame.

2. A box spring assembly as set forth in claim 1 wherein said intermediate deck support springs include a load bearing portion and a yielding portion.

3. A box spring assembly as set forth in claim 2 wherein said yielding portion is mounted at lower ends to said frame and terminates at upper ends in said load bearing portion.

4. A box spring assembly as set forth in claim 3 wherein said yielding portion has upwardly converging lower members, upwardly diverging upper members, and generally horizontally torsion bars connected at opposite ends to said upper and lower members.

5. A box spring assembly as set forth in claim 4 wherein said torsion bars are capable of abutting engagement with one another to thereby limit the deflection of said yieldable portion.

6. A box spring assembly as set forth in claim 2 wherein said load bearing portion includes torsion bars extending generally parallel to said straight wire members and under said crosswire members, a crossing member crossing over said crosswire members, and connecting members connecting said torsion bars to opposite ends of said crossing member.

7. A box spring assembly as set forth in claim 1 wherein said frame includes side rails, end rails, and cross rails.

8. A box spring assembly as set forth in claim 1 wherein said end springs are substantially vertically oriented.

9. A box spring assembly as set forth in claim 1 wherein said end springs include alternating substantially vertical and horizontal sections.

10. A box spring assembly comprising:

a generally horizontal rectangular frame;

a generally horizontal mattress support deck disposed a predetermined distance above said frame, said support deck including a border wire generally aligned with said frame, and a plurality of deck wires extending lengthwise of said frame and being connected at opposing ends to said border wire, said deck wires including integral sinuous end springs extending downward from said border wire to said frame;

a plurality of spring units, each spring unit including a generally horizontal crosswire member extending crosswire of said frame and having at opposite ends thereof a pair of downwardly extending integral sinuous end springs, said sinuous end springs being secured to said frame at their lower ends and being secured to said border wire at their upper ends, each of said end springs being located in a substantially vertical plane extending downwardly from said border wire; and a plurality of limited deflection intermediate spring modules, said spring modules having an upper portion connected with said crosswire members and having a pair of downward extending yieldable portions fixedly attached to said frame.

11. A box spring assembly according to claim 10 wherein said deck wire end springs are substantially vertically oriented.

12. A box spring assembly according to claim 10 wherein each of said deck wire end springs is located in a substantially vertical plane extending from said border wire to said frame.

13. A box spring assembly according to claim 10 wherein said deck wire end springs include alternating generally vertical and horizontal sections.

14. A box spring assembly according to claim 10 wherein said end springs include alternating generally vertical and horizontal sections.

15. A box spring assembly according to claim 10 wherein said end springs are generally planar and include alternating sections with at least one section extending upward.

* * * * *